US009423736B2

(12) United States Patent
Nakayama

(10) Patent No.: US 9,423,736 B2
(45) Date of Patent: Aug. 23, 2016

(54) HEATER AND IMAGE HEATING APPARATUS INCLUDING THE SAME

(71) Applicant: CANON KABUSHIKI KAISHA, Tokyo (JP)

(72) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,497

(22) Filed: May 22, 2015

(65) Prior Publication Data

US 2015/0338806 A1 Nov. 26, 2015

(30) Foreign Application Priority Data

May 26, 2014 (JP) ..... 2014-108593

(51) Int. Cl.
*G03G 15/20* (2006.01)
*H05B 3/26* (2006.01)

(52) U.S. Cl.
CPC ..... *G03G 15/2053* (2013.01); *G03G 15/20* (2013.01); *H05B 3/265* (2013.01); *H05B 2203/006* (2013.01); *H05B 2203/013* (2013.01)

(58) Field of Classification Search
CPC ..... G03G 15/80; G03G 15/2042; G03G 15/2053; G03G 15/2082; G03G 15/20; H01C 17/06; H01C 17/28; H01C 17/283; H05B 1/0241; H05B 3/20; H05B 3/24
See application file for complete search history.

(56) References Cited

U.S. PATENT DOCUMENTS 6,336,009 B1 1/2002 Suzumi et al.
6,377,775 B1 4/2002 Nakayama et al.
6,456,818 B1 9/2002 Nakayama et al.
6,564,032 B2 5/2003 Hara et al.
6,687,481 B2 2/2004 Watanabe et al.
6,704,536 B2 3/2004 Nakayama
(Continued)

FOREIGN PATENT DOCUMENTS

JP 7-160131 A1 6/1995
JP 2000-162909 A 6/2000
JP 2012-37613 A 2/2012

OTHER PUBLICATIONS

Masayuki Tamaki et al., U.S. Appl. No. 14/799,056, filed Jul. 14, 2015.
(Continued)

*Primary Examiner* — Erika J Villaluna
(74) *Attorney, Agent, or Firm* — Fitzpatrick, Cella, Harper & Scinto

(57) ABSTRACT

A heater usable with an image heating apparatus including first and second terminals includes: a first connector connectable with the first terminal; a second connector connectable with the second terminal and positioned with a gap from the first connector in a longitudinal direction of the substrate; a third connector connectable with the second terminal; a fourth connector connectable with the second terminal and positioned with a gap from the third connector in the widthwise; and heat generators arranged in the longitudinal direction. The heat generators include heat generators activatable by the first connector and the second connector, by the first connector and the third connector, and by the first connector and the fourth connector. A gap between the third connector and the fourth connector in the widthwise direction is smaller than a gap between the first connector and the second connector in the longitudinal direction.

12 Claims, 12 Drawing Sheets

(56) References Cited

U.S. PATENT DOCUMENTS

| | | | |
|---|---|---|---|
| 6,961,526 | B2 | 11/2005 | Tezuka et al. |
| 6,978,110 | B2 | 12/2005 | Nakayama |
| 7,079,801 | B2 | 7/2006 | Nakayama |
| 7,106,986 | B2 | 9/2006 | Nakayama |
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |
| 7,729,628 | B2 | 6/2010 | Nakayama |
| 7,907,861 | B2 | 3/2011 | Nakayama |
| 8,145,086 | B2 | 3/2012 | Chiyoda et al. |
| 8,306,446 | B2 | 11/2012 | Ito et al. |
| 8,559,837 | B2 | 10/2013 | Nakayama |
| 8,705,996 | B2 | 4/2014 | Takemura et al. |
| 8,712,271 | B2 | 4/2014 | Nakayama |
| 8,750,738 | B2 | 6/2014 | Hano et al. |
| 8,750,739 | B2 | 6/2014 | Tamaki et al. |
| 8,995,865 | B2 | 3/2015 | Tamaki et al. |
| 2002/0150412 | A1 | 10/2002 | Nakayama |
| 2012/0224876 | A1 | 9/2012 | Nakayama et al. |
| 2013/0299480 | A1 | 11/2013 | Kakubari et al. |
| 2013/0322897 | A1 | 12/2013 | Yago et al. |
| 2015/0016853 | A1 | 1/2015 | Nakayama |
| 2015/0071690 | A1 | 3/2015 | Miyahara et al. |

OTHER PUBLICATIONS

Shigeaki Takada et al., U.S. Appl. No. 14/798,613, filed Jul. 14, 2015.
Toshinori Nakayama, U.S. Appl. No. 14/719,474, filed May 22, 2015.
Toshinori Nakayama, U.S. Appl. No. 14/718,672, filed May 21, 2015.
Toshinori Nakayama, U.S. Appl. No. 14/794,869, filed Jul. 9, 2015.
Toshinori Nakayama, U.S. Appl. No. 14/718,557, filed May 21, 2015.
Naoki Akiyama et al., U.S. Appl. No. 14/755,098, filed Jun. 30, 2015.
Copending, unpublished U.S. Appl. No. 14/799,056 dated Jul. 14, 2015, to Masayuki Tamaki et al.
Copending, unpublished U.S. Appl. No. 14/798,613 dated Jul. 14, 2015, to Shigeaki Takada et al.
Copending, unpublished U.S. Appl. No. 14/719,474 dated May 22, 2015, to Toshinori Nakayama.
Copending, unpublished U.S. Appl. No. 14/718,672 dated May 21, 2015, to Toshinori Nakayama.
Copending, unpublished U.S. Appl. No. 14/794,869 dated Jul. 9, 2015, to Toshinori Nakayama.
Copending, unpublished U.S. Appl. No. 14/718,557 dated May 21, 2015, to Toshinori Nakayama.
Copending, unpublished U.S. Appl. No. 14/755,098 dated Jun. 30, 2015, to Naoki Akiyama et al.

HEATER AND IMAGE HEATING APPARATUS INCLUDING THE SAME

FIELD OF THE INVENTION AND RELATED ART

The present invention relates to a heater for heating an image on a sheet and an image heating apparatus provided with the same. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is recently proposed (Japanese Laid-open Patent Application 2012-37613) in which a heat generating element (heater) is contacted to an inner surface of a thin flexible belt to apply heat to the belt. Such a fixing device is advantageous in that the structure has a low thermal capacity, and therefore, the temperature rise to allow the fixing operation is quick.

Japanese Laid-open Patent Application 2012-37613 discloses a structure of a fixing device in which a heat generating region width of a heat generating element (heater) is controlled in accordance with a width size of the sheet. FIG. 11 is a circuit diagram of the heater disclosed in Japanese Laid-open Patent Application 2012-37613. As shown in FIG. 11, the fixing device comprises electrodes 1027 (1027*a*-1027*f*) arranged in a longitudinal direction of a substrate 1021 and heat generating resistance layers 1025), and the electric power supply is supplied through the electrodes to the heat generating resistance layers 1025 (1025*a*-1025*e*) so that the heat generating resistance layer generates heat.

In this fixing device, each electrode is electrically connected with an electroconductive line layers 1029 (1029*a*, 1029*b*) formed on the substrate. More specifically, the electroconductive line layer connected with the electrode 1027*b* and the electrode 1027*d* extends toward one longitudinal end of the substrate. The electroconductive line layer 1029*a* connected with the electrode 1027*c* and the electrode 1027*e* extends toward another longitudinal end of the substrate. In the one end portion of the substrate with respect to the longitudinal direction, the electrode 1027*a* and the electroconductive line layer 1029*b* are connectable with respective electroconductive members. In the other end portion of the substrate with respect to the longitudinal direction, the electrode 1027*f* and the electroconductive line layer 1029*a* are connectable with respective electroconductive members. In more detail, the opposite longitudinal end portions of the substrate is not coated with an insulation layer for protecting the electroconductive lines, and the electroconductive line layers 1029*a* 1029*b* and the electrodes 1027*a*, 1027*f* are exposed. Therefore, the heater 1006 is connected to a voltage supply circuit by the electroconductive member contacted to exposed stations of electroconductive line layers 1029*a*, 1029*b* and electrodes 1027*a*, 1027*f*. The voltage supply circuit includes an AC voltage source and switches 1033 (1033*a*, 1033*b*, 1033*c*, 1033*d*), by combinations of the actuations of which heater energization pattern is controlled. In other words, the electroconductive line layers 1029*a*, 1029*b* are selectively connected with a voltage source contact 1031*a* or a voltage source contact 1031*b* in accordance with the intended connection pattern. With such a structure, the fixing device disclosed in Japanese Laid-open Patent Application 2012-37613 thereby changes the width size of the heat generating region of the heat generating resistance layer 1025 in accordance with the width size of the sheet to be heated.

Here, for simplicity, the exposed portion of the electroconductive line layer 1029*a* will be called electrical contact A, the exposed portion of the electroconductive line layer 1029*b* is called electrical contact B, the exposed portion of the electrode 1027*a* will be called electrical contact C, and the exposed portion of the electrode 1027*f* will be called electrical contact D. With the structure disclosed in Japanese Laid-open Patent Application 2012-37613 in which the electrical contacts An and D and electrical contacts B and C are arranged in the widthwise direction of the substrate, the length of the substrate can be reduced as compared with the structure in which the electrical contacts are arranged in the longitudinal direction of the substrate.

As shown in part (a) of FIG. 11, when the heater 1006 generates heat for the maximum width sheet, the electrical contacts An and C are connected with the voltage source contact 1031*a*, and the electrical contacts B and D are connected with the voltage source contact 1031*b*. That is, the electrical contacts A and D which are adjacent to each other in the widthwise direction of the substrate are connected with different voltage source contacts, and the electrical contacts B and C which are adjacent to each other in the widthwise direction of the substrate are connected with different voltage source contacts. Therefore, a short circuit attributable to creepage discharge tends to occur between the electrical contacts A and D, and between the electrical contacts B and C. In order to prevent the short circuit, it is required to provide a sufficiently wide clearance between the electrical contacts A and D and between the electrical contacts B and C.

However, if sufficiently wide gaps are provided between the electrical contacts arranged in the widthwise direction of the substrate 1021, the substrate 1021 is required to have a sufficiently large width. As a result, the substrate 1021 increases in size in the widthwise direction which leads to an increase in cost.

A heater in which a width size of the heat generating region is changeable is desired to suppress an increase of the width of the substrate resulting from the arrangement of the electrical contacts in the widthwise direction of the substrate.

SUMMARY OF THE INVENTION

It is an object of the present invention to provide a heater having a relatively smaller width.

It is another object of the present invention to provide an image heating apparatus having a relatively smaller width.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a substrate; a first connecting portion electrically connectable with the first terminal; a second connecting portion electrically connectable with the second terminal and provided adjacent to the first connecting portion with a gap in a longitudinal direction of said substrate; a third connecting portion electrically connectable with the second terminal; a fourth connecting portion electrically connectable with the second terminal and provided adjacent to the third connecting portion with a gap in the widthwise direction of said substrate; and a plurality of heat generating portions arranged in the longitudinal direction of the substrate. The heat generating portions include at least one heat generating portion capable of generating heat by electric energy supplied from the first connecting portion and the second connecting portion, at least one heat generating portion capable of generating heat by electric energy supplied from the first connecting portion and the third connecting portion, and at least one heat generating portion capable of generating heat by electric energy supplied from the first connecting portion and the fourth connecting portion. A gap between the third connecting portion and the fourth connecting portion in the widthwise direction is smaller than a gap between the first connecting portion and the second connecting portion in the longitudinal direction.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer

Embodiment 1

Image Forming Apparatus

Figure 1:
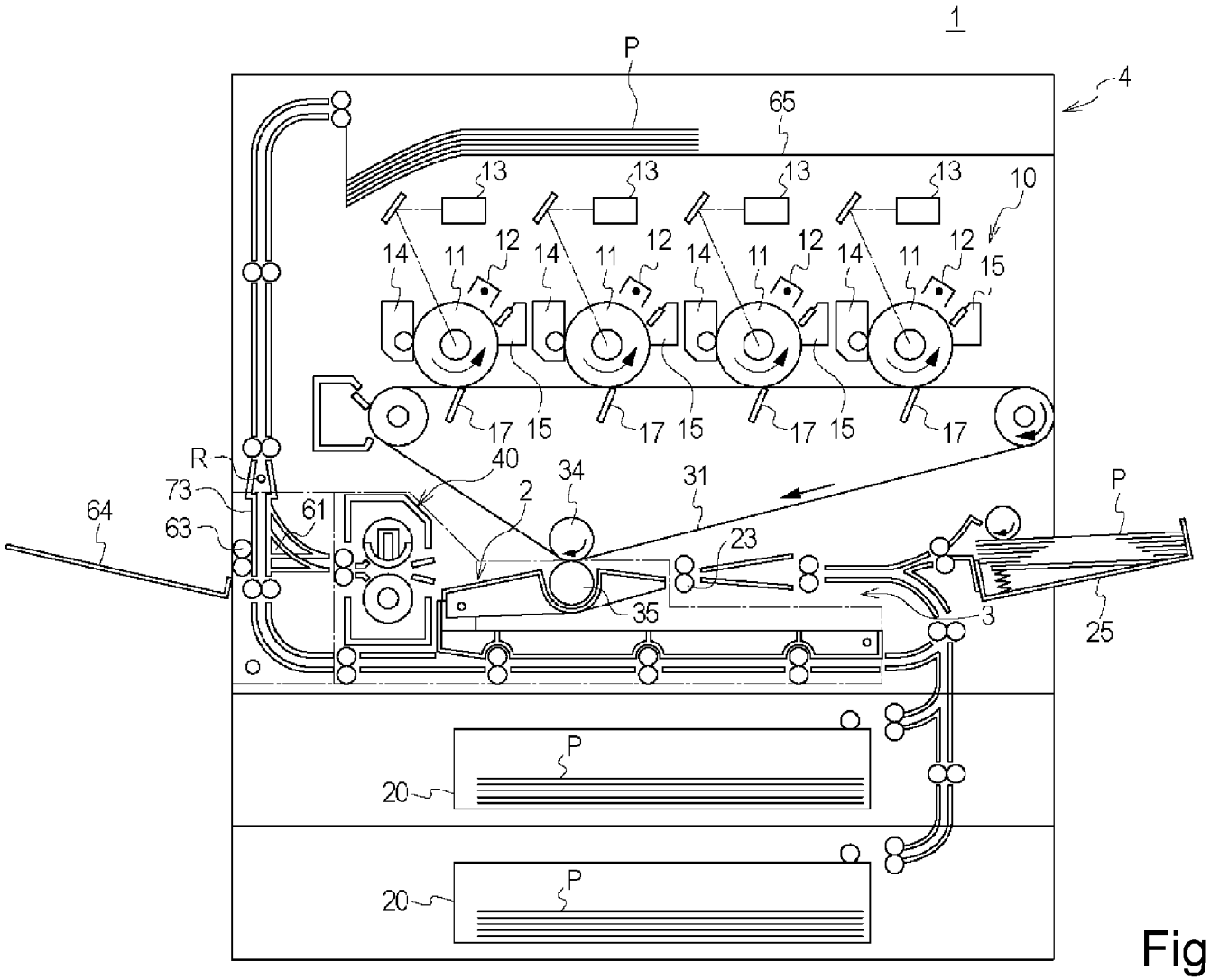
FIG. 1 is a section of view of the image forming apparatus according to an Embodiment 1 of the present invention.

FIG. 1 is a sectional view of the printer 1, which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and), Bk (black). The image forming stations 10 include respective photosensitive drums 11 (11Y, 11M, 11C, 11Bk), corresponding to Y, M, C, Bk colors, arranged in the order named from the left side. Around each drum 11, similar elements are provided as follows: a charger 12 (12Y, 12M, 12C, 12Bk); an exposure device 13 (13Y, 13M, 13C, 13Bk); a developing device 14 (14Y, 14M, 14C, 14Bk); a primary transfer blade 17 (17Y, 17M, 17C, 17Bk); and a cleaner 15 (15Y, 15M, 15C, 15Bk). The structure for the Bk toner image formation will be described as a representative example, and the descriptions for the other colors are omitted for simplicity by assigning the like reference numerals. So, the elements will be simply called the photosensitive drum 11, the charger 12, the exposure device 13, the developing device 14, the primary transfer blade 17 and the cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheets P contained in a feeding cassette 20 are placed on a multi-feeding tray 25 and picked up by a feeding mechanism (unshown) and fed to a pair of registration rollers. The sheet P is a member on which the image is formed. Specific examples of the sheet P are plain paper, a thick sheet, a resin material sheet, an overhead projector film or the like. The pair of registration rollers 23 once stops the sheet P to correct oblique feeding. The registration rollers 23 then feed the sheet P into between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
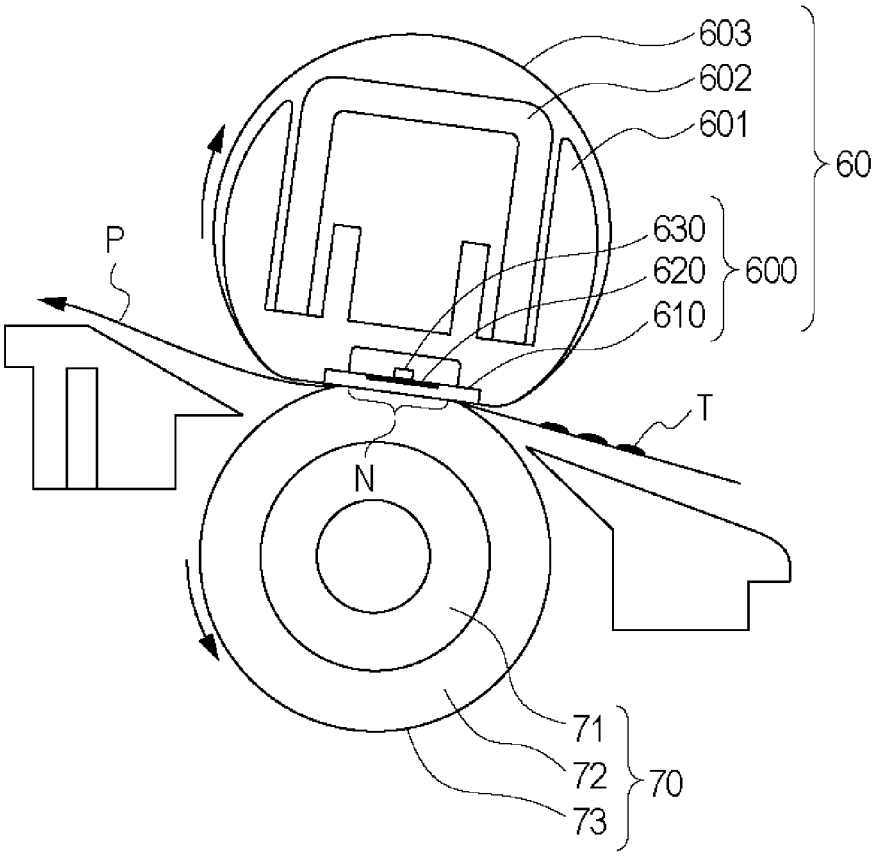
FIG. 2 is a sectional view of an image heating apparatus according to an Embodiment 1 of the present invention.
Figure 3:
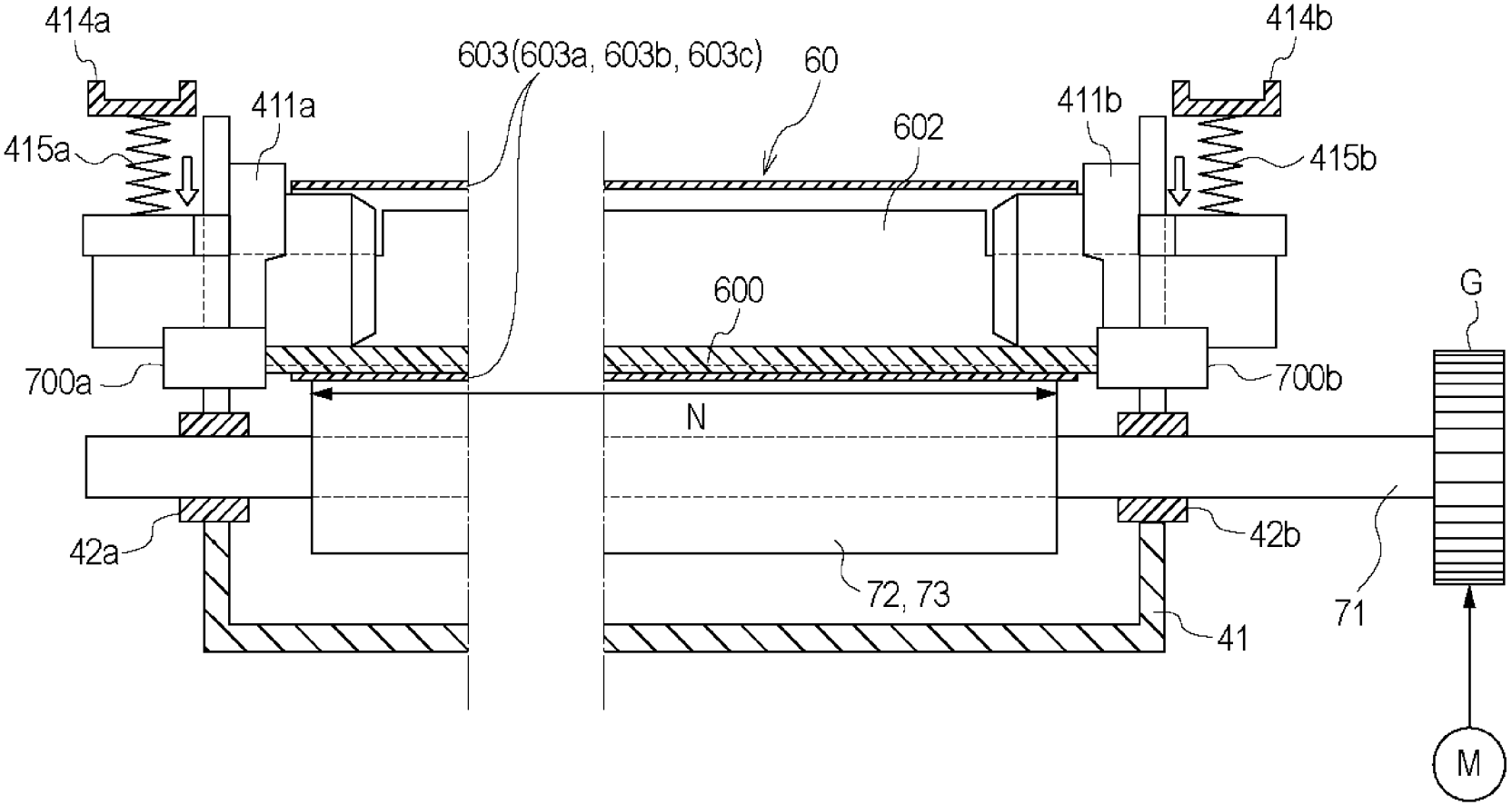
FIG. 3 is a front view of an image heating apparatus according to Embodiment 1 of the present invention.
Figure 5:
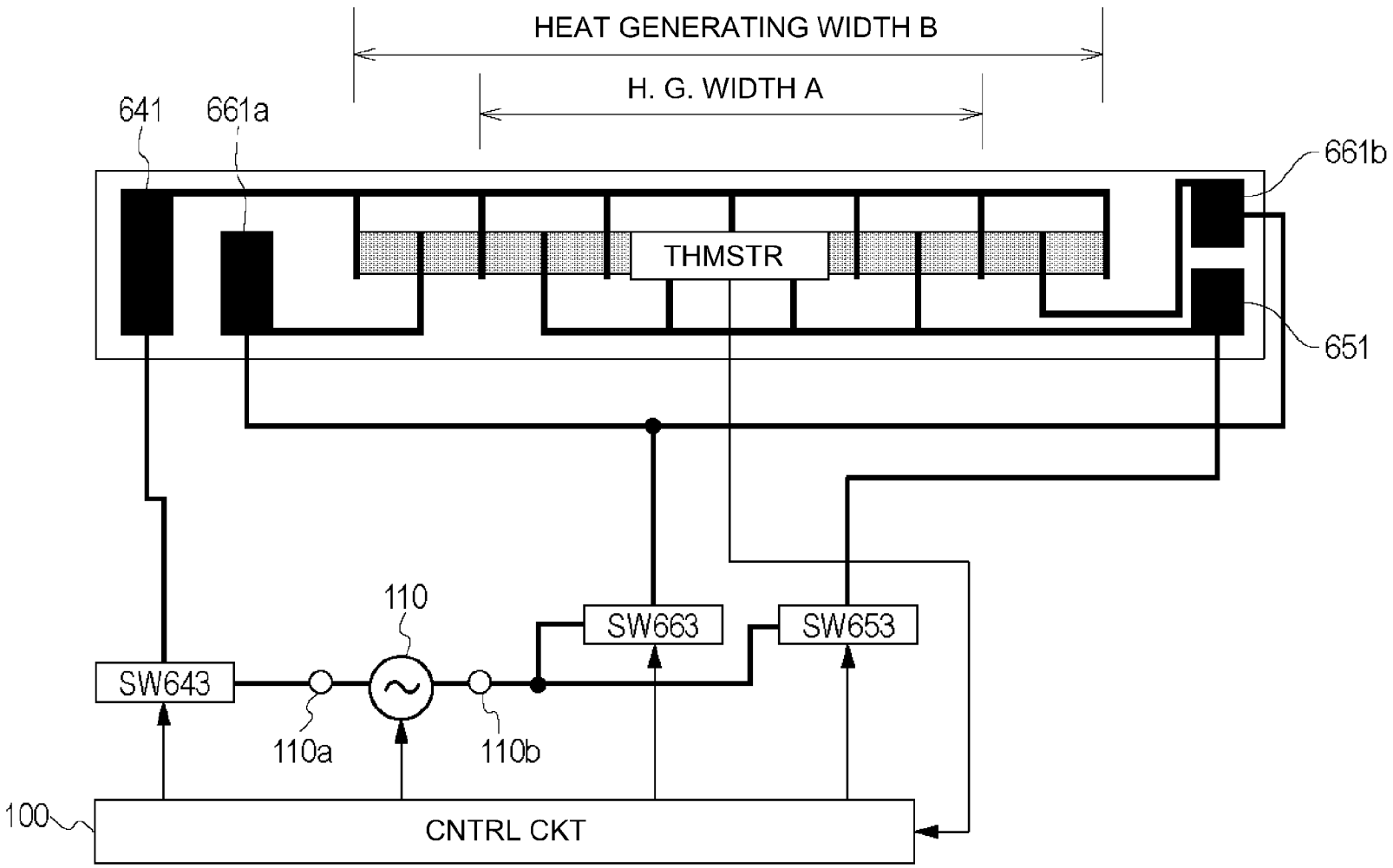
FIG. 5 illustrates the structural the relationship of the image heating apparatus according to an Embodiment 1.

The fixing device 40, which is the image heating apparatus used in the printer 1, will be described FIG. 2 is a sectional view of the fixing device 40. FIG. 3 is a front view of the fixing device 40. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and a heater 600 contacted to the inner surface of the belt 603 to heat the belt 603 (low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) 29 to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail in conjunction with the accompanying drawings.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the left-right direction in FIG. 2), 350-400 mm in the length (the dimension measured in the front-rear direction in FIG. 2), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610 is not in slidable contact with the belt 603, but the heat generating element 620 may be provided on the front surface of the substrate 610 is in slidable contact with the belt 603. However, the heat generating element 620 is preferably provided on the back side of the substrate 610, by which a uniform heating effect to the substrate 610 is accomplished, from the standpoint of preventing non-uniform heat application which may be caused by a non-heat generating portion of the heat generating element 620. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of approx. 30 mm in the outer diameter, approx. 330 mm in the length (the dimension measured in the front-rear direction in FIG. 2), approx. 30 μm in the thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

The belt contacting surface of the substrate 610 may be provided with a polyimide layer having a thickness of approx. 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called urging spring 415. With such a structure, the elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is approx. 156.8 N at one end portion side and approx. 313.6 N (32 kgf) in total.

As shown in FIG. 3, connectors 700*a*, 700*b* are provided as an electric energy supply member electrically connected with the heater 600 to supply the electric power to the heater 600. The connectors 700*a*, 700*b* may be simply called connector 700. The connector 700*a* is detachably provided at one longitudinal end portion of the heater 600. The connector 700*b* is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing good maintenance property. Details of the connector 700 will be described hereinafter.

As shown in FIG. 2, the roller 70 is a nip forming member which contacts an outer surface of the belt 603 to cooperate with the belt 603 to form the nip N The roller 70 has a multi-layer structure on the metal core of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are approx. 25 mm in outer diameter, and approx. 330 mm in length.

A thermistor 630 is a temperature sensor provided on a back side of the heater 600 (opposite side from the sliding surface side. The thermistor 630 is bonded to the heater 600 in the state that it is insulated from the heat generating element 620. The thermistor 630 has a function of detecting the a temperature of the heater 600. As shown in FIG. 5, the thermistor 630 is connected with a control circuit 100 through an A/D converter (unshown) and feed an output corresponding to the detected temperature to the control circuit 100.

The control circuit 100 comprises a circuit including a CPU operating for various controls, a non-volatilization medium such as a ROM storing various programs. The programs are stored in the ROM, and the CPU reads and execute them to effect the various controls. The control circuit 100 may be an integrated circuit such as ASIC if it is capable of performing the similar operation.

As shown in FIG. 5, the control circuit 100 is electrically connected with the voltage source 110 so as to control is electric power supply from the voltage source 110. The control circuit 100 is electrically connected with the thermistor 630 to receive the output of the thermistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the thermistor 630. In this embodiment, the control circuit 100 carries out a wave number control of the output of the voltage source 110 to adjust an amount of heat generation of the heater 600. By such a control, the heater 600 is maintained at a predetermined temperature (approx. 180 degree C., for example).

As shown in FIG. 3, the metal core 71 of the roller 70 is rotatably held by bearings 41*a* and 41*b* provided in a rear side and a front side of the side plate 41, respectively. One axial end of the metal core is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving portion for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

Figure 4:
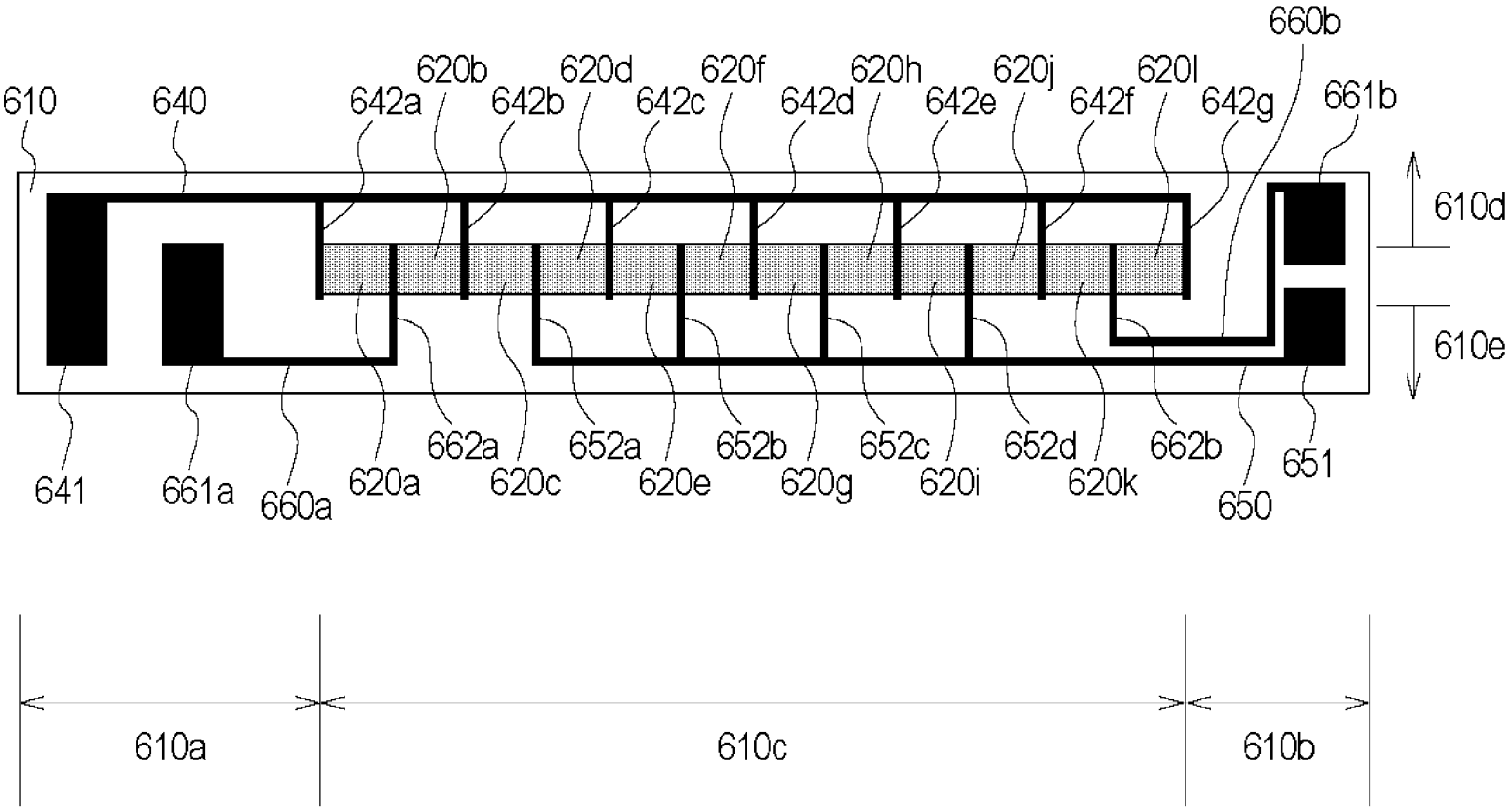
FIG. 4 illustrates a structure of a heater Embodiment 1.
Figure 6:
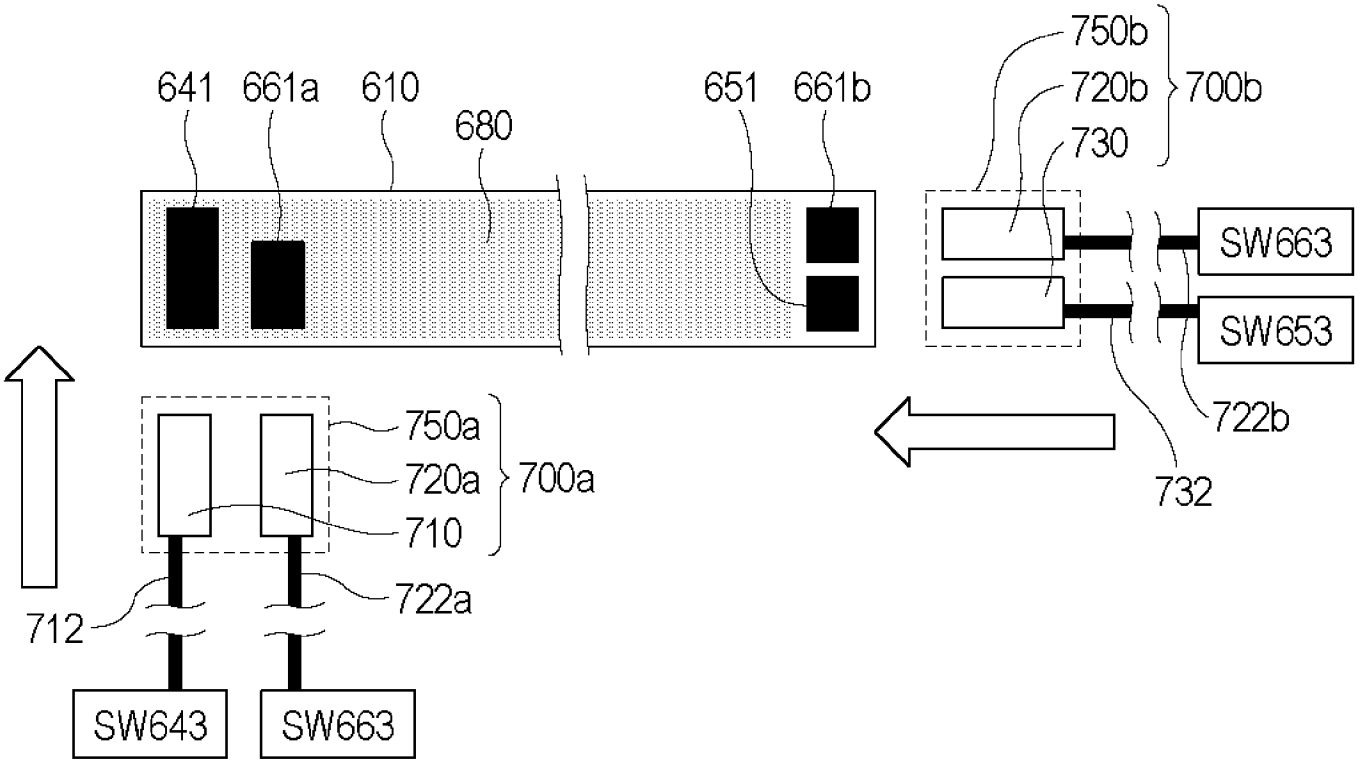
FIG. 6 illustrates mounting of a connector.
Figure 12:
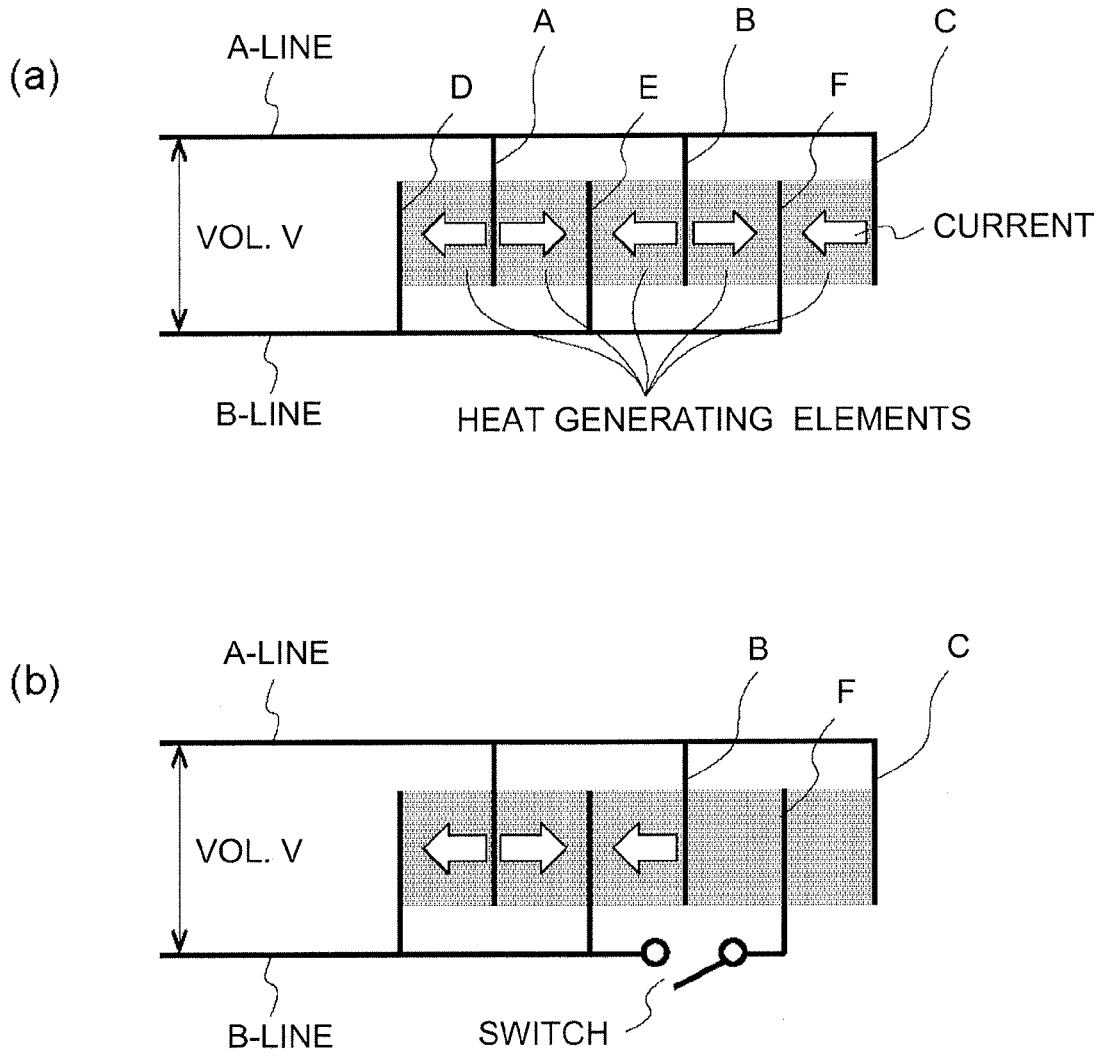
Fig. 12 PRIOR ART
FIG. 12 is an illustration (a) of heat generating type used with a heater, and an illustration (b) of a switching type for a heat generating region used with the heater.

The structure of the heater 600 used in the fixing device 40 will be described in detail. FIG. 4 illustrates a structure of a heater Embodiment 1. FIG. 6 illustrates a connector. Part (a) of FIG. 12 illustrates a heat generating type used in the heater 600. Part (b) of FIG. 12 illustrates a heat generating region switching type used with the heater 600.

Figure 11:
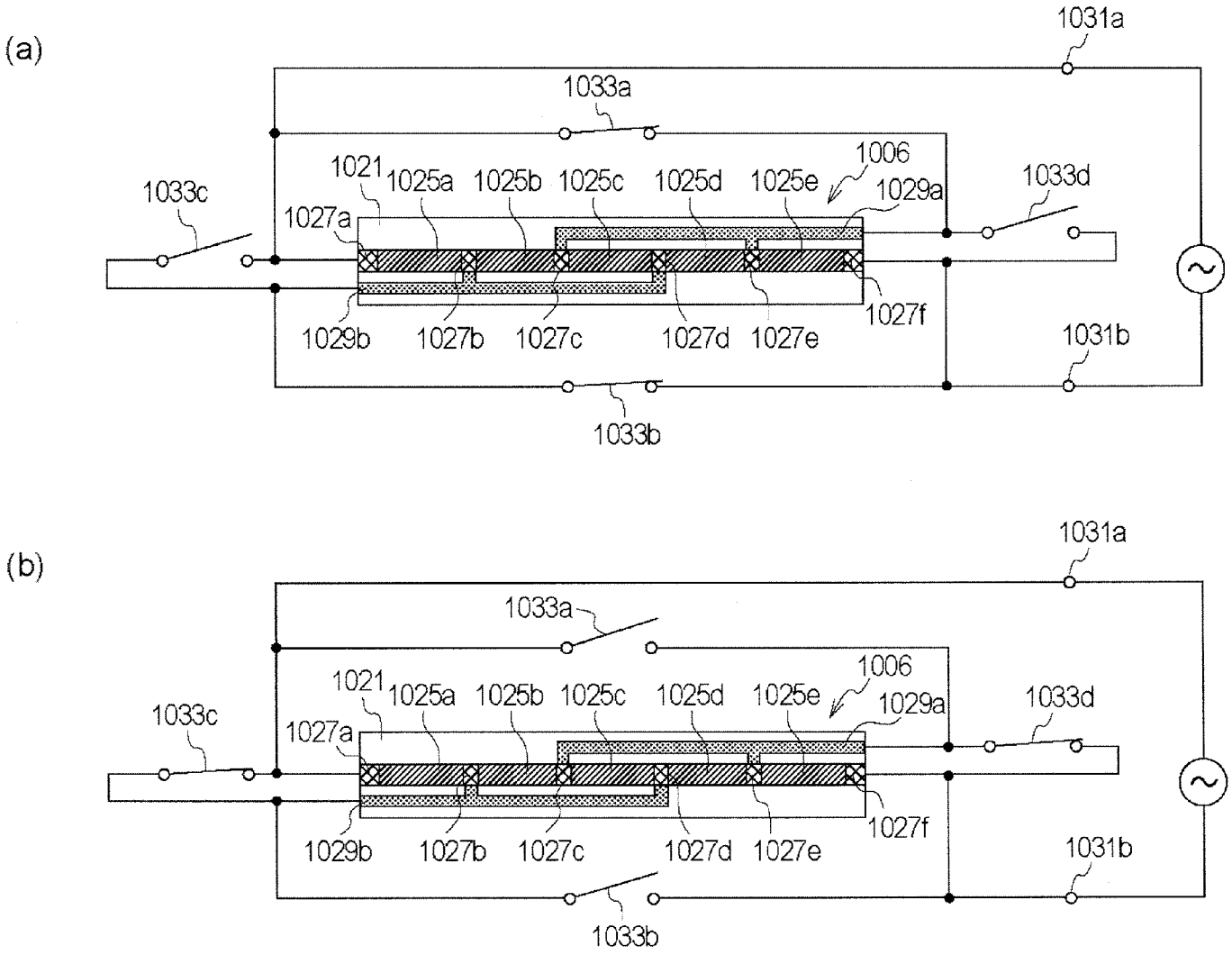
Fig. 11 PRIOR ART
FIG. 11 is a circuit diagram of a conventional heater.

The heater 600 of this embodiment is a heater using the heat generating type shown in parts (a) and (b) of FIG. 12. As shown in part (a) of FIG. 11, electrodes A-C are electrically connected with the A-electroconductive-line, and electrodes D-F are electrically connected with B-electroconductive-line. The electrodes connected with the A-electroconductive-lines and the electrodes connected with the B-electroconductive-lines are interlaced (alternately arranged) along the longitudinal direction (left-right direction in part (a) of FIG. 11), and heat generating elements are electrically connected between the adjacent electrodes. When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in part (b) of FIG. 12, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, with the system, the heat generating region can be changed by providing a switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in part (a) of FIG. 11) in the following manner. When joule heat generation is effected by the electric energization of the heat generating element, the heat generating element generates heat corresponding to the resistance value thereof, and therefore, the dimensions and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current which flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In addition, when a high resistance material is used for the heat generating element, a temperature non-uniformity may result from non-uniformity in the thickness of the heat generating element when it is energized. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individuality to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of a short circuit. In addition, the number of required electrodes is large with the result of large non-heat generating portion. Therefore, it is preferable to arrange the heat generating elements and the electrodes such that an electrode is made common between adjacent heat generating elements. With such an arrangement, the likelihood of a short circuit between the electrodes can be avoided, and the non-heat generating portion can be made small.

In this embodiment, a common electroconductive line 640 corresponds to A-electroconductive-line of part (a) of FIG. 12, and opposite electroconductive lines 650, 660*a*, 660*b* correspond to B-electroconductive-line. In addition, common electrodes 642*a*-642*g* correspond to electrodes A-C of part (a) of FIG. 12, and opposite electrodes 652*a*-652*d*, 662*a*, 662*b* correspond to electrodes D-F. Heat generating elements 620*a*-620*l* correspond to the heat generating elements of part (a) of FIG. 12. Hereinafter, the common electrodes 642*a*-642*g* are simply common electrode 642. The opposite electrodes 652*a*-652*e* are simply called opposite electrode 652. The opposite electrodes 662*a*-662*e* are simply called opposite electrode 662. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of approx. 400 mm, a width (up-down direction in FIG. 4) of approx. 8 mm and a thickness of approx. 1 mm.

On the back side of the substrate 610, the heat generating element 620 and the electroconductor pattern (electroconductive line) are provided through a thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern are coated with the insulation coating layer 680 of heat resistive glass so that they are electrically protected from leakage and a short circuit.

As shown in FIG. 4, there are provided an electrical contact 641 (one of a grounding contact and a non-grounding contact) and an electrical contact 661*a* (the other of the grounding contact and the non-grounding contact) as a part of the electroconductor pattern in one end portion side of the substrate 610 with respect to the longitudinal direction. In the other end portion side 610*b* of the substrate 610 with respect to the longitudinal direction, there are provided the electrical contacts 651 (the other of the grounding contact and the non-grounding contact), 661*b* (the other of the grounding contact and the non-grounding contact) as a part of the electroconductor pattern. In a central region 610*c* of the substrate 610 with respect to the longitudinal direction, the heat generating element 620 and the common electrode 642 and the opposite electrodes 652, 662 as a part of the electroconductor pattern are provided. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating elements 620 (620*a*-620*l*) are resistors for generating joule heat upon electric power supply thereto. The heat generating element 620 is one heat generating element member extending in the longitudinal direction on the substrate 610, and is disposed in the region 610*c* (FIG. 4) adjacent to the center portion of the substrate 610. The heat generating element 620 has a desired resistance value, and has a width (measured in the widthwise direction of the substrate 610) of 1-4 mm, a thickness of 5-20 μm. The heat generating element 620 in this embodiment has the width of approx. 2 mm and the thickness of approx. 10 μm. A total length of the heat generating element 620 in the longitudinal direction is approx. 320 mm, which is enough to cover a width of the A4 size sheet P (approx. 297 mm in width).

On the heat generating element 620, seven common electrodes 642*a*-642*g* which will be described hereinafter are laminated with intervals in the longitudinal direction. In other words, the heat generating element 620 is isolated into six sections by common electrodes 642*a*-642*g* along the longitudinal direction. The lengths measured in the longitudinal direction of the substrate 610 of each section are approx. 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are approx. 26.7 mm. Resistance values of the sub-section of the heat generating element 620 with respect to the longitudinal direction are approx. 120Ω. With such a structure, the heat generating element 620 is capable of generating heat in a partial area or areas with respect to the longitudinal direction.

The resistivities of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, the heat uniforming function of the substrate 610 makes the influence on the fixing process negligible if the width of the electrode is not more than 1 mm, for example. In this embodiment, the width of each electrode is not more than 1 mm. The common electrodes 642 (642*a*-642*g*) are a part of the above-described electroconductor pattern. The common electrode 642 extends in the widthwise direction of the substrate 610 perpendicular to the longitudinal direction of the heat generating element 620. In this embodiment, the common electrode 642 is laminated on the heat generating element 620. The common electrodes 642 are odd-numbered electrodes of the electrodes connected to the heat generating element 620, as counted from a one longitudinal end of the heat generating element 620. The common electrode 642 is connected to one contact 110*a* of the voltage source 110 through the common electroconductive line 640 which will be described hereinafter.

The opposite electrodes 652, 662 are a part of the above-described electroconductor pattern. The opposite electrodes 652, 662 extend in the widthwise direction of the substrate 610 perpendicular to the longitudinal direction of the heat generating element 620. The opposite electrodes 652, 662 are laminated on the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660 which will be described hereinafter.

The common electrode 642 and the opposite electrode 652, 662 function to supply the electric power to the heat generating element 620.

In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four may be the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 which is in turn connected with the heat generating element 620. The common electroconductive line 640 is connected to the electrical contact 641 which will be described hereinafter. In this embodiment, in order to assure the insulation of the insulation coating layer 680, a gap of approx. 400 μm is provided between the common electroconductive line 640 and each opposite electrode.

The opposite electroconductive line 650 is a part of the above-described electroconductor pattern. The opposite electroconductive line 650 extends along the longitudinal direction of substrate 610 toward the other end portion 610*b* of the substrate in the other end portion side 610*e* of the substrate. The opposite electroconductive line 650 is connected with the opposite electrode 652 which is in turn connected with the heat generating element 620. The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the one end portion side 610*a* of the substrate in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661*a* which will be described hereinafter. The opposite electroconductive line 60*b* extends along the longitudinal direction of substrate 610 toward the other end portion 610*b* of the substrate in the other end portion side 610*e* of the substrate. The opposite electroconductive line 660*b* is connected to an opposite electrode 662*b* which is in turn connected with the heat generating element 620 (620*k*, 620*l*). The opposite electroconductive line 660*b* is connected to the electrical contact 661*b* which will be described hereinafter. In this embodiment, an approx. 400 μm gap is provided between the opposite electroconductive line 660*a* and the common electrode 642 and between the opposite electroconductive line 660*b* with common electrode 642 so that the electrical insulation is assured by the insulation coating layer 680. In addition, between the opposite electroconductive lines 600*b* and 650, an approx. 100 μm gap is provided.

The electrical contacts 641, 651, 661*a*, 661*b* are a part of the above-described electroconductor pattern. In one end portion side 610*a* of the substrate, the electrical contacts 641, 661*a* are provided. In other end portion side 610*b* of the substrate, the electrical contacts 651, 661*b* are provided. As shown in FIG. 6, the portion including the electrical contacts 641, 651, 661*a*, 661*b* is not coated with the insulation coating layer 680, so that the electrical contacts 641, 651, 661*a*, 661*b* are exposed. Therefore, the electrical contacts 641, 661*a* function as a connecting portion for contacting to and electrically connecting to the connector 700*a*. Therefore, the electrical contacts 651, 661*b* function as a connecting portion for contacting to and electrically connecting to the connector 700*b*.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, and the directions of the currents through the adjacent heat generating elements are substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700, a potential difference is produced between the common electrode 642*a*-642*b*) and the opposite electrode 662*a*. Therefore, through the heat generating elements 620*a*, 620*b*, the currents flow along the longitudinal direction of the substrate 610, and the directions of the currents through the adjacent heat generating elements are substantially opposite to each other. The heat generating elements 620*a*, 620*b* as a second heat generating region adjacent the first heat generating region generate heat.

When voltage is applied between the electrical contact 641 and the electrical contact 661*a* through the connection between the heater 600 and the connector 700, a potential difference is produced between the common electrode 642*f*, 642*g* and the opposite electrode 662*b* through the common electroconductive line 640 and the opposite electroconductive line 660*b*. Therefore, through the heat generating elements 620*k*, 620*l*, the currents flow along the longitudinal direction of the substrate 610, and the directions of the currents through the adjacent heat generating elements are substantially opposite to each other. By this, the heat generating elements 620*k*, 620*l* as a third heat generating region adjacent to the first heat generating region generate heat.

In this manner, by selecting the electrical contacts supplied with the voltage, the desired one or ones of the heat generating elements 620*a*-620*l* can be selectively energized. In this embodiment, the first heat generating region, the second heat generating region and the third heat generating region include a plurality of heat generating elements, respectively, but they may include one heat generating element, respectively.

[Connector]

Figure 7:
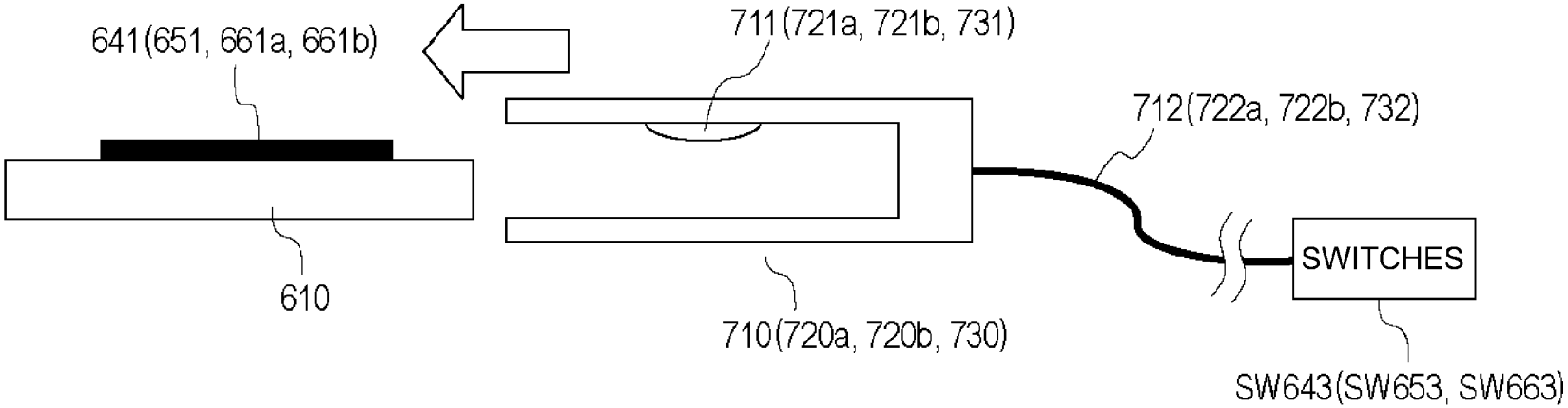
FIG. 7 illustrates a contact terminal.

The connector 700 used with the fixing device 40 will be described in detail. FIG. 7 is an illustration of a terminal 710. The connectors 700*a* and 700*b* of this embodiment includes terminals (which may be called terminal) 710, 720*a*, 720*b*, 730, which are electrically connected with the heater 600 by being mounted to the heater 600. More particularly, as shown in FIG. 6, the connector 700*a* includes the terminal 710 contactable to and electrically connectable to the electrical contact 641, and the terminal 720*a* contactable to and electrically connectable to the electrical contact 661*a*. The terminals 710, 720*a* are contained in a housing 750*a*. The connector 700*b* includes a terminal 720*b* contactable to and electrically connectable to the electrical contact 661*b*, and a terminal 730 contactable four and the electrically connectable to the electrical contact 651. The terminals 720*b*, 730 are contained in a housing 750*a*. By the connectors 700*a*, 700*b* being mounted to the heater 600 to sandwich the heater 600, the terminals are connected with the corresponding electrical contacts. In the fixing device 40 of this embodiment having the above-described the structures, no soldering or the like is used for the electrical connection between the connectors and the electrical contacts. Therefore, the electrical connection between the heater 600 and the connector 700 rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 6, the connector 700*a* provided with the terminals 710, 720*a* of metal is mounted to the heater 600 from an end portion with respect to the widthwise direction of the substrate 610 in the one end portion side 610*a* of the substrate. The connector 700*b* provided with the terminals 720*b*, 730 is mounted to the heater 600 from a longitudinal end portion of the substrate 610 in the other end portion side 610*b* of the substrate.

The terminals 710, 720*a*, 720*b*, 730 will be described taking the terminal 710*a* as an example. The terminal 710*a* electrically connects the electrical contact 641 with a switch SW643 which will be described hereinafter. As shown in FIG. 7, the contact terminal 710*a* is provided with a cable 712 for the electrical connection between the switch SW643 and the electrical contact 711 for contacting to the electrical contact 641. The contact terminal 710 has a channel-like configuration, and by moving in the direction indicated by an arrow in FIG. 6, it can receive the heater 600. The portion of the connector 700*a* which contacts the electrical contact 641 is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and back sides to fix the position of the heater 600.

Similarly, the contact terminal 720*a* functions to contact the electrical contact 661*a* with the switch SW663 which will be described hereinafter. The contact terminal 720*a* is provided with the electrical contact 721*a* for contacting to the electrical contact 661*a* and a cable 722*a* for the electrical connection with the switch SW643.

Similarly, the contact terminal 720*b* functions to contact the electrical contact 661*b* with the switch SW663 which will be described hereinafter. The contact terminal 720*b* is provided with a cable 722*b* for the electrical connection between the switch SW643 and the electrical contact 721*b* for contacting to the electrical contact 661*b*.

Similarly, the contact terminal 730 functions to contact the electrical contact 651 with the switch SW663 which will be described hereinafter. The contact terminal 730 is provided with a cable 722*a* for the electrical connection between the switch SW643 and the electrical contact 731 for contacting to the electrical contact 651.

The terminals 710, 720*a* of metal are supported by the housing 750*a* of the resin material. The terminals 710, 720*a* are disposed in the housing 750*a* with a gap therebetween so as to connect with the electrical contacts 641, 661*a* when the connector 700*a* is mounted to the heater 600. Between the terminals, a partition is provided to assure the electrical insulation between the terminals.

The terminals 720*b*, 730 of metal are supported by the housing 750*b* of the resin material. The terminal 720*b*, 730 are disposed with a gap therebetween in the housing 750*b* so as to contact with the electrical contacts 661*b*, 651, respectively, when the connector 700*b* is mounted to the heater. Between the terminals, a partition is provided to assure the electrical insulation between the terminals.

In the above-described example, the connector 700*a* is mounted to the end portion with respect to the widthwise direction of the substrate 610, and the connector 700*b* is mounted to the substrate 610 in the longitudinal end portion of the substrate, but this is not limiting to the present invention, and another combination of the mounting directions of the connector 700 to the substrate 610. For example, the connector 700*b* may also be mounted to the heater from the end portion with respect to the widthwise direction of the substrate, similarly to the connector 700*a*.

[Electric Energy Supply to Heater]

An electric energy supply method to the heater 600 will be described. The fixing device 40 of this embodiment is capable of changing the a width of the heat generating region of the heater 600 by controlling the electric energy supplied to the heater 600 in accordance with the width size of the sheet P.

With such a structure, the heat can be efficiently supplied to the sheet P. In the fixing device 40 of this embodiment, the sheet P is fed with the center of the sheet P aligned with the center of the fixing device 40, and therefore, the heat generating region extends from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) of approx. 100V in effective value (single phase AC). The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW643 connects or disconnects between the voltage source contact 110*a* and the electrical contact 641 in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 functions as an electric energy supplying portion for supplying the electric power to the heater 600.

When the sheet P is a large size sheet (an usable maximum width size), that is, when A3 size sheet is fed in the longitudinal direction or when the A4 size is fed in the landscape fashion, the width of the sheet P is approx. 297 mm. Therefore, the control circuit 100 controls the electric power supply to provide the heat generation width B (FIG. 5) of the heat generating element 620. To effect this, the control circuit 100 renders ON all of the switch SW643, switch SW653, switch SW663. As a result, the heater 600 is supplied with the electric power through the electrical contacts 641, 661*a*, 661*b*, 651, and all of the 12 sub-sections of the heat generating element 620 generate heat. At this time, the heater 600 generates the heat uniformly over the approx. 320 mm region to meet the approx. 297 mm sheet P.

When the size of the sheet P is a small size (narrower than the maximum width), that is, when an A4 size sheet is fed longitudinally, or when an A5 size sheet is fed in the landscape fashion, the width of the sheet P is approx. 210 mm. Therefore, the control circuit 100 provides a heat generation width A (FIG. 5) of the heat generating element 620. Therefore, the control circuit 100 renders ON the switch SW643, switch SW663 and renders OFF the switch SW653. As a result, the heater 600 is supplied with the electric power through the electrical contacts 641, 651, so that 8 sub-sections of the 12 sub-sections of the heat generating element 620 generate heat. At this time, the heater 600 generates the heat uniformly over the approx. 213 mm region to meet the approx. 210 mm sheet P.

[Disposition of Electrical Contact]

Figure 8:
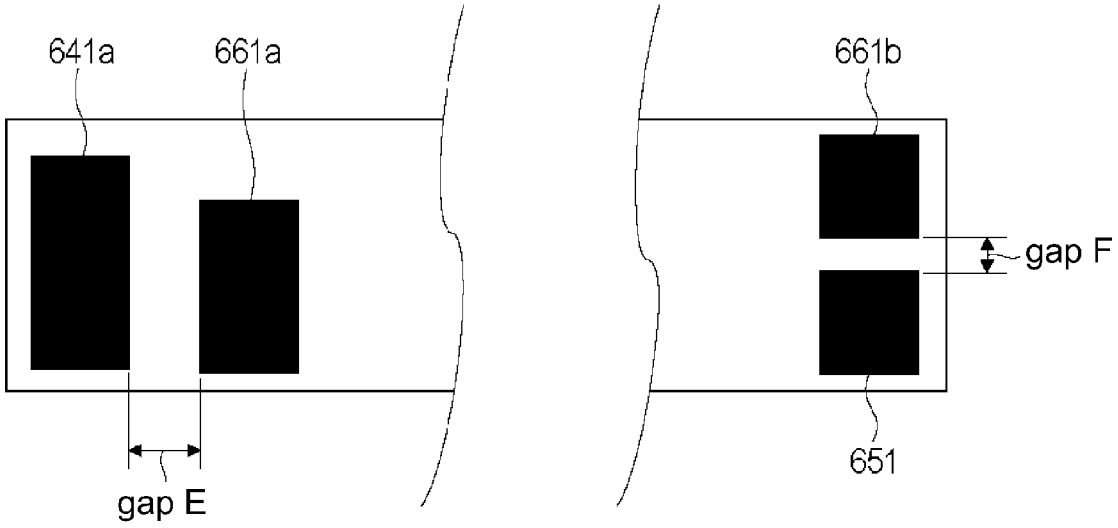
FIG. 8 illustrates an arrangement of the electrical contacts in Embodiment 1.

The disposition or arrangement of the electrical contacts will be described. FIG. 8 shows the arrangement of the electrical contacts in this embodiment. In this embodiment, adjacent electrical contacts connected to the same voltage source contact are arranged in the widthwise direction of the substrate 610, and the adjacent to electrical contacts connected to the different voltage source contact are arranged in the longitudinal direction of the substrate 610. With such an arrangement, sufficient gaps can be provided between the adjacent electrical contacts connected to the different voltage source contacts. By providing narrow gaps between the electrical contacts connected to the same voltage source contact, the enlargement of the width of the substrate can be suppressed. By the electrical contacts connected to the same voltage source contact being arranged in the widthwise direction, the number of the electrical contacts arranged in the longitudinal direction can be reduced, and therefore, the increase of the length of the substrate can be suppressed.

In this embodiment, in the one end portion side 610*a* of the substrate, the electrical contact 641 connecting to the voltage source contact 110*a* and the electrical contact 661*a* connecting to the voltage source contact 110*b* are arranged in the longitudinal direction. In addition, in the other end portion side 610*b* of the substrate, the electrical contacts 651, 661*b* connecting to the voltage source contact 110*b* are arranged in the widthwise direction of the substrate 610. A description will be provided in detail in conjunction with the accompanying drawings.

As described hereinbefore, in this embodiment, the electrical contacts 641, 661*a* are disposed in the one end portion side 610*a* of the substrate, and the electrical contacts 651, 661*b* are disposed in other end portion side 610*b* of the substrate. Each electrical contact has a size of not less than 2.5 mm×2.5 mm (widthwise direction and longitudinal direction of the substrate) so as to receive the electric energy from the terminal assuredly, and the area thereof is preferably lives. In this embodiment, the dimensions of the electrical contact 641 are approx. 7 mm×approx. 3 mm, that of the electrical contact 661*a* are approx. 5 mm×approx. 3 mm, and that of the electrical contact 661*b* and 651 are approx. 5 mm×approx. 3 mm.

As described hereinbefore, the portion of the substrate 610 provided with the electrical contacts 641, 651, 661*a*, 661*b* is not coated with the insulation coating layer. That is, the electrical contacts are exposed, and therefore, the provision of the gaps between adjacent electrical contacts is desirable to prevent the electrical leakage and/or short circuit. With the increase of the insulation distance, the risk of the leakage and/or a short circuit decreases, but on the other hand, the substrate 610 is increased in size. Therefore, proper sizes of the gaps between the adjacent electrical contacts are desirable.

In this embodiment, the electrical contact 641 is connected to the voltage source contact 110*a*, and the electrical contact 661*a* is connected to the voltage source contact 110*b*. In other words, the electrical contacts 641 and 661*a* which are connected to the different (opposite polarities) voltage source contacts are adjacent to each other, with the result of large potential difference therebetween. In order to prevent a short circuit due to creepage discharge, it is preferable to provide a sufficiently large insulation distance between the electrical contact 641 and the electrical contact 661*a*. Japanese Electrical Appliance and Material Safety Law (annex Table of attached Table) stipulates that in a charging portion or other position of different polarities where a voltage between the lines 50V-150V, the required space distance (creeping distance) is approx. 2.5 mm. In this embodiment, taking mounting tolerances of the connector 700 and/or the thermal expansion of the substrate 610 into account, the gap E is approx. 4.0 mm. When the gap between the electrical contacts 641 and 661*a* is not constant because of non-parallelism between the electrical contacts 641 and 661*a*, a minimum value of the gap is deemed as the gap E.

In this embodiment, the electrical contacts 651, 661*b* are connected to the voltage source contact 110*b*. That is, the electrical contacts 651 and 661*b* which are adjacent to each other are connected to the same voltage source contact (same polarity), and therefore no large potential difference is produced therebetween. Therefore, a short circuit due to the creepage discharge hardly occurs between the electrical contacts 651 and 661*b* (gap F). Therefore, as long as a function of insulation for normal operation of the heater 600 is provided, the gap F can be made minimum. However, in consideration of the mounting tolerances of the connector 700 and the thermal expansion of the substrate 610, the gap F in this embodiment is approx. 1.5 mm. When the gap between the electrical contacts 641 and 661*a* is not constant because of non-parallelism between the electrical contacts 641 and 661*a*, a minimum value of the gap is deemed as the gap F. Gap E>gap F. The gap between the electrical contact 661*a* and the electrical contact 651 is less than gap E in the entirety, by which the width required by the electrical contacts can be reduced. Therefore, the width of the electrical contacts in total in the other end portion side 610*b* of the substrate is approx. 7.5 mm, and therefore, the electrical contacts can be accommodating in the substrate 610 having the width of approx. 8 mm. If the electrical contacts 651 and 661*b* are connected with different voltage source contacts, the width of the electrical contacts in total is approx. 10 mm. Therefore, the electrical contacts are not provided in the substrate 610 of the width of approx. 8 mm, which necessitates enlargement of the width of the substrate 610.

That is, by arranging the electrical contacts connected to the different voltage source contacts are arranged in the longitudinal direction of the substrate 610, the gap between the electrical contacts can be made sufficient. In addition, by arranging the electrical contacts connected to the same voltage source contact are arranged in the widthwise direction of the substrate, the number of the electrical contacts arranged in the longitudinal direction of the substrate can be reduced. Even though the electrical contacts connected to the same voltage source contacts are arranged in the widthwise direction of the substrate, the increase of the width of the substrate 610 can be suppressed by reducing the gap therebetween.

Embodiment 2

Figure 9:
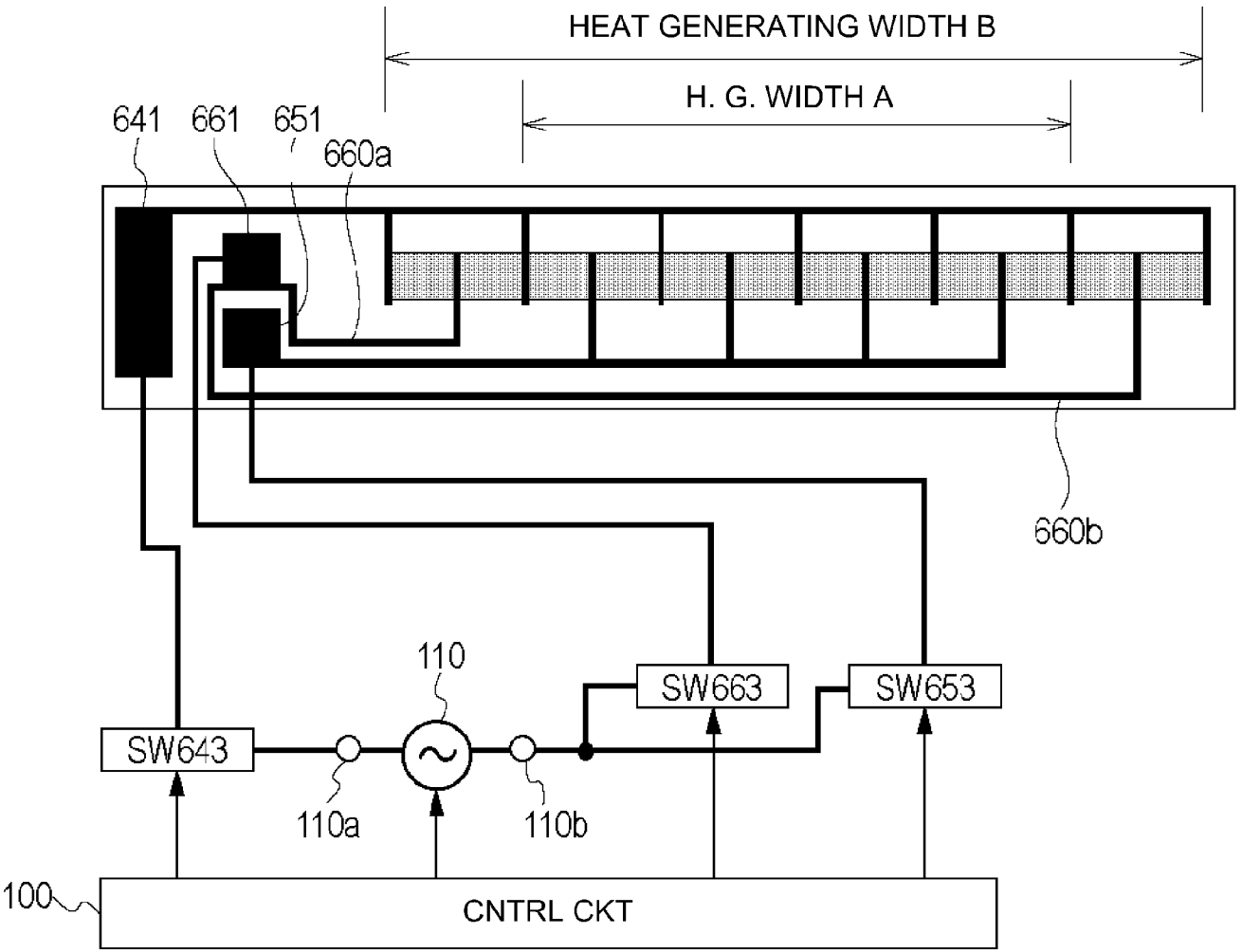
FIG. 9 illustrates the structural the relationship of the image heating apparatus according to an Embodiment 1.
Figure 10:
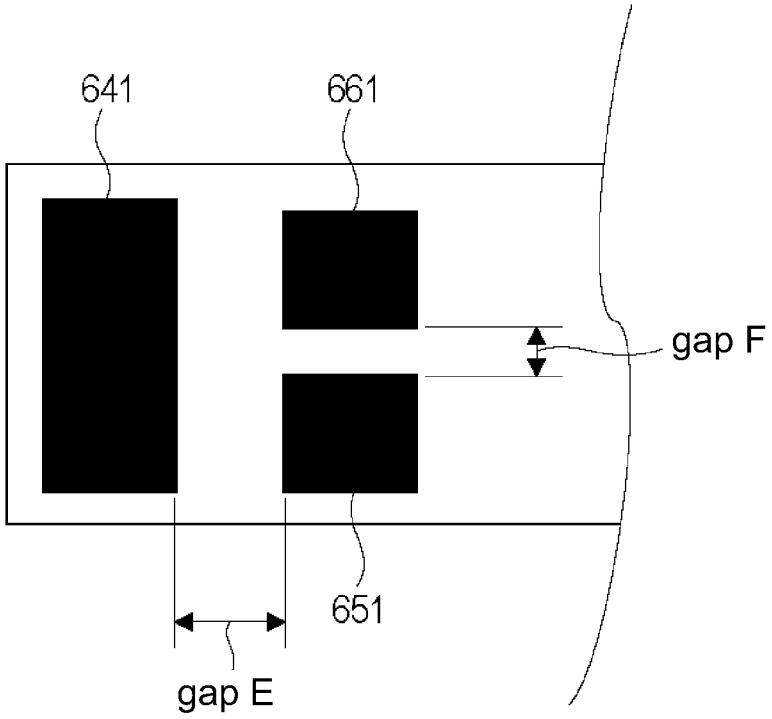
FIG. 10 illustrates an arrangement of the electrical contacts in Embodiment 2.

A heater according to Embodiment 2 of the present invention will be described. FIG. 9 is an illustration of a structure relation of the image heating apparatus of this embodiment. FIG. 9 shows the arrangement of the electrical contacts in this embodiment. FIG. 8 shows the arrangement of the electrical contacts in this embodiment. In Embodiment 1, the heat generating element 620 is supplied with the electric energy from the electrical contacts disposed in the opposite longitudinal end portions of the substrate 610. In Embodiment 2, the heat generating element 620 it is supplied with the electric energy from the electrical contacts provided one longitudinal end portion of the substrate 610. More particularly, the electrical contacts 661*a*, 661*b* (electrical contact 661) in Embodiment 1 are concentrated in one end portion side 610*a* of the substrate. That is, all the electrical contacts 641, 651, 661 are in the one end portion side 610*a* of the substrate. With this structure of this embodiment, the length of the substrate is reduced. The details of the heater 600 of this embodiment will be described in conjunction with the drawings. The structures of the fixing device 40 of Embodiment 2 are fundamentally the same as those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

As shown in FIG. 9, in the heater 600 of this embodiment, the heat generating element 620 is supplied with the electric power through the electrical contacts 641, 651, 661 provided in one end portion side of the substrate 610 with respect to the longitudinal direction. The electrical contact 661 is disposed adjacent to the electrical contact 641 with a gap therebetween, and they are arranged in the longitudinal direction of the substrate 610. The electrical contact 661 is disposed adjacent to the electrical contact 641 with a gap therebetween, and they are arranged in the longitudinal direction of the substrate 610. The electrical contact 661 disposed adjacent to the electrical contact 651 with a gap therebetween, and are arranged in the widthwise direction of the substrate.

In the heater 600 of this embodiment, the opposite electroconductive lines 660*a* and 660*b* extend so as to surround the electrical contact 651. With such a structure, the opposite electroconductive lines 660*a* and 660*b* are connected to the electrical contact 661. The 661 electrical contact functions as the electrical contacts 661*a* and 661*b* of Embodiment 1.

In this embodiment, the dimension of the electrical contact 641 is approx. 7 mm×approx. 3 mm, and the dimension of the electrical contacts 661*a* and 651 are approx. 3 mm×approx. 3 mm.

The opposite electroconductive line 650 extends along the longitudinal direction of the substrate 610 toward the one end portion side 610*a* of the substrate in another end portion side with respect to the widthwise direction substrate 610 beyond the heat generating element 620. The opposite electroconductive line 650 is connected to the electrical contact 651.

In this embodiment, the electrical contact 641 is connected to the voltage source contact 110*a*, and the electrical contact 661 is connected to the voltage source contact 110*b*. In other words, the electrical contacts 641 and 661 which are connected to the different voltage source contacts are adjacent to each other, with the result of large potential difference therebetween. In order to prevent a short circuit due to creepage discharge, it is preferable to provide a sufficiently large insulation distance between the electrical contact 641 and the electrical contact 661. The desired space distance (creeping distance) is approx. 2.5 mm. In consideration of the mounting tolerances of the connector 700 and the thermal expansion of the substrate 610, the gap E in this embodiment is approx. 4 mm.

Since the electrical contact 651 is connected to the voltage source contact 110*b*, a sufficient insulation distance is desirably provided between the electrical contact 641 and the electrical contact 661. Therefore, the gap E between the electrical contacts 641 and 651 is approx. 4.0 mm in this embodiment.

Since the electrical contacts 651 and 661 are contacted to the voltage source contact 110*b*, no large potential difference is produced therebetween. Therefore, a short circuit due to the creepage discharge hardly occurs between the electrical contacts 651 and 661*a* (gap F). Therefore, as long as a function of insulation for normal operation of the heater 600 is provided, the gap F can be made minimum. However, in consideration of the mounting tolerances of the connector 700 and the thermal expansion of the substrate 610, the gap F in this embodiment is approx. 1.5 mm. Thus, gap E>gap F.

Therefore, the width of the electrical contacts in total in the other end portion side 610*b* of the substrate is approx. 7.5 mm, and therefore, the electrical contacts can be accommodating in the substrate 610 having the width of approx. 8 mm. If the electrical contacts 651 and 661*b* are connected with different voltage source contacts, the width of the electrical contacts in total is approx. 10 mm, and therefore, the electrical contacts are not provided in the substrate 610 of the width of approx. 8 mm.

This, according to this embodiment, by arranging the electrical contacts connected to the different voltage source contacts are arranged in the longitudinal direction of the substrate 610, the gap between the electrical contacts can be made sufficient. In addition, by arranging the electrical contacts connected to the same voltage source contact are arranged in the widthwise direction of the substrate, the number of the electrical contacts arranged in the longitudinal direction of the substrate can be reduced. Even though the electrical contacts connected to the same voltage source contacts are arranged in the widthwise direction of the substrate, the increase of the width of the substrate 610 can be suppressed by reducing the gap therebetween. The heaters per se of the foregoing embodiments can be summarized as follows:

A heater comprising:

a substrate;

a first connecting portion electrically connectable with one of grounding and non-grounding sides of a power source;

a second connecting portion electrically connectable with the other of the grounding and non-grounding sides and provided adjacent to the first connecting portion with a gap in a longitudinal direction of the substrate;

a third connecting portion electrically connectable with the other of the grounding and non-grounding sides;

a fourth connecting portion electrically connectable with the other of the grounding and non-grounding sides and provided adjacent to the third connecting portion with a gap in the widthwise direction of the substrate;

a plurality of heat generating portions arranged in the longitudinal direction of the substrate, the heat generating portions including at least one heat generating portion capable of generating heat by electric energy supplied from the first connecting portion and the second connecting portion, at least one heat generating portion capable of generating heat by electric energy supplied from the first connecting portion and the third connecting portion, and at least one heat generating portion capable of generating heat by electric energy supplied from the first connecting portion and the fourth connecting portion;

a gap between the third connecting portion and the fourth connecting portion in the widthwise direction is smaller than a gap between the first connecting portion and the second connecting portion in the longitudinal direction.

OTHER EMBODIMENTS

The present invention is not restricted to the specific dimensions in the foregoing embodiments. The dimensions may be changed properly by one skilled in the art depending on the situations. The embodiments may be modified in the concept of the present invention.

The electric energy supply to the heat generating element 610 is not limited to that in the longitudinal direction of the substrate. For example, by sandwiching the heat generating element in the widthwise direction by electrodes, the electric current may flow in the widthwise direction of the substrate. With such a structure, the present invention is applicable if there are provided an electrical contact connected to one of the terminals of the voltage source and a plurality of electrical contacts connected to the other terminal of the voltage source. In such a case, the electrical contacts connected to the same polarity are arranged in the widthwise direction of the substrate, and the electrical contacts connected to the opposite polarities are arranged in the longitudinal direction of the substrate, so that the gap between the electrical contacts connected to the same polarity is reduced, by which the increase of the width of the substrate can be suppressed.

The heat generating region of the heater 600 is not limited to the above-described examples which are based on the sheets are supplied with the center thereof aligned with the center of the fixing device. Alternatively, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, cone. The heat generating region in the one end portion side may be enlarged.

The number of patents of the heat generating region of the heater 600 is not limited to two. For example, three or more patents may be provided.

The forming method of the heat generating element 620 is not limited to those disclosed in Embodiments 1, 2. In Embodiment 1, the common electrode 642 and the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The number of the electrical contacts limited to three or four. Five or more electrical contacts may be provided if the electrical contacts connected to the same voltage source contact are arranged in the widthwise direction of the substrate. For example, in Embodiment 1, in one end portion side 610*a* of the substrate, an electrical contact different from the electrical contacts 641, 661*a* may be provided, and the other end portion side 610*b* of the substrate, an electrical contact different from the electrical contacts 661*b*, and 651 may be provided.

The electrical contact connected to the voltage source contact 110*a* is not limited to the electrical contact 641. For example, in the one end portion side 610*a* of the substrate, an electrical contact which is different from the electrical contact 641 and which is connected to the voltage source contact 110*a* may be provided. Furthermore, this electrical contact may be provided adjacent to the electrical contact 641 with a gap therebetween in the widthwise direction of the substrate 610.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108593 filed on May 26, 2014, which is hereby incorporated by reference herein in its entirety.

What is claimed is:

1. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a first connecting portion electrically connectable with the first terminal;

a second connecting portion electrically connectable with the first terminal and provided adjacent to said first connecting portion with a gap in a longitudinal direction of said substrate;

a third connecting portion electrically connectable with the second terminal;

a fourth connecting portion electrically connectable with the second terminal and provided adjacent to said third connecting portion with a gap in a widthwise direction of said substrate; and a plurality of heat generating portions arranged in the longitudinal direction of said substrate, said heat generating portions including at least one heat generating portion capable of generating heat by electric energy supplied from said first connecting portion and said second connecting portion, at least one heat generating portion capable of generating heat by electric energy supplied from said first connecting portion and said third connecting portion, and at least one heat generating portion capable of generating heat by electric energy supplied from said first connecting portion and said fourth connecting portion, wherein a gap between said third connecting portion and said fourth connecting portion in the widthwise direction of said substrate is smaller than a gap between said first connecting portion and said second connecting portion in the longitudinal direction of said substrate.

2. A heater according to claim 1, wherein a dimension of an array of said first connecting portion and said second connecting portion in the longitudinal direction of said substrate is larger than a width of said substrate.

3. A heater according to claim 1, wherein said first connecting portion and said second connecting portion are provided in one end portion side of the substrate with respect to the longitudinal direction, and said third connecting portion and said fourth connecting portion are provided in another end portion side of the substrate with respect to the longitudinal direction.

4. A heater according to claim 3, wherein a dimension of an array of said first connecting portion and said second connecting portion in the longitudinal direction of said substrate is larger than a width of said substrate.

5. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a first connecting portion connectable with the first terminal;

a second connecting portion connectable with the first terminal and provided adjacent to said first connecting portion with a gap in a longitudinal direction of said substrate;

a third connecting portion connectable with the second terminal and provided adjacent to said second connecting portion with a gap in a widthwise direction of said substrate; and a plurality of heat generating portions arranged in the longitudinal direction of said substrate, said heat generating portions including at least one heat generating portion capable of generating heat by electric energy supplied from said first connecting portion and said second connecting portion, and at least one heat generating portion capable of generating heat by electric energy supplied from said first connecting portion and said third connecting portion, wherein a gap between said second connecting portion and said third connecting portion in the widthwise direction of said substrate is smaller than the gap between said first connecting portion and said second connecting portion in the longitudinal direction and is smaller than the gap between said first connecting portion and said third connecting portion in the longitudinal direction of said substrate.

6. An image heating apparatus comprising:

a belt configured to heat an image on a sheet;

a substrate extending in a widthwise direction of said belt;

a first connecting portion provided on said substrate;

a second connecting portion provided on said substrate adjacent to said first connecting portion with a gap in a longitudinal direction of said substrate;

a third connecting portion provided on said substrate;

a fourth connecting portion provided on said substrate adjacent to said third connecting portion with a gap in a widthwise direction of said substrate;

a plurality of heat generating portions arranged in the longitudinal direction on said substrate, said heat generating portions including at least one heat generating portion capable of generating heat by electric energy supplied from said first connecting portion and said second connecting portion, at least one heat generating portion capable of generating heat by electric energy supplied from said first connecting portion and said third connecting portion, and at least one heat generating portion capable of generating heat by electric energy supplied from said first connecting portion and said fourth connecting portion; and an electric energy supplying portion provided with a first terminal and a second terminal, wherein when a sheet having a maximum width usable with said apparatus is heated, said electric energy supplying portion supplies electric energy to all of said heat generating portions by contacting said first connecting portion with said first terminal and contacting said second, third and fourth connecting portions to said second terminal so that all of said heat generating portions generate heat, and wherein when a sheet having a width smaller than the maximum width is heated, said electric energy supplying portion supplies electric energy to a part of said second heat generating portions by contacting said first connecting portion with said first terminal and contacting a part of said second, third and fourth connecting portions to said second terminal so that a part of said heat generating portions generate heat, wherein a gap between said third connecting portion and said fourth connecting portion in the widthwise direction of said substrate is smaller than a gap between said first connecting portion and said second connecting portion in the longitudinal direction of said substrate.

7. An apparatus according to claim 6, wherein a dimension of an array of said first connecting portion and said second connecting portion in the longitudinal direction of said substrate is larger than a width of said substrate.

8. An apparatus according to claim 6, wherein said first connecting portion and said second connecting portion are provided in one end portion side of the substrate with respect to the longitudinal direction, and said third connecting portion and said fourth connecting portion are provided in another end portion side of the substrate with respect to the longitudinal direction.

9. An apparatus according to claim 6, wherein said electric energy supplying portion includes an AC circuit.

10. An image heating apparatus comprising:

a belt configured to heat an image on a sheet;

a substrate extending in a widthwise direction of said belt;

a first connecting portion provided on said substrate;

a second connecting portion provided on said substrate adjacent to said first connecting portion with a gap in a longitudinal direction of said substrate;

a third connecting portion provided on said substrate adjacent to said second connecting portion with a gap in a widthwise direction of said substrate;

a plurality of heat generating portions arranged in the longitudinal direction on said substrate, said heat generating portions including a heat generating portion capable of generating heat by electric energy supplied from said first connecting portion and said second connecting portion, and a heat generating portion capable of generating heat by electric energy supplied from said first connecting portion and said third connecting portion; and an electric energy supplying portion provided with a first terminal and a second terminal, wherein when a sheet having a maximum width usable with said apparatus is heated, said electric energy supplying portion supplies electric energy to all of said heat generating portions by contacting said first connecting portion with said first terminal and contacting said second and third connecting portions to said second terminal so that all of said heat generating portions generate heat, and wherein when a sheet having a width smaller than the maximum width is heated, said electric energy supplying portion supplies electric energy to a part of said second heat generating portions by contacting said first connecting portion with said first terminal and contacting one of said second and third connecting portions to said second terminal so that a part of said heat generating portions generate heat, wherein a gap between said second connecting portion and said third connecting portion in the widthwise direction of said substrate is smaller than a gap between said first connecting portion and said second connecting portion in the longitudinal direction of said substrate.

11. An apparatus according to claim 10, wherein a dimension of an array of said first connecting portion and said second connecting portion in the longitudinal direction of said substrate is larger than a width of said substrate.

12. An apparatus according to claim 10, wherein said electric energy supplying portion includes an AC circuit.

* * * * *